US005694870A

United States Patent [19]

Morgulis et al.

[11] Patent Number: 5,694,870

[45] Date of Patent: Dec. 9, 1997

[54] SEWING MACHINE WITH MATERIAL CUTTING ROLLS

[75] Inventors: Lazar A. Morgulis, Norcross; Charles Zimmerman, Suwanee; Anatoly Berdichevsky, Atlanta, all of Ga.

[73] Assignee: Juki America, Inc., Suwanee, Ga.

[21] Appl. No.: 526,260

[22] Filed: Sep. 11, 1995

[51] Int. Cl.[6] ..... D05B 37/08

[52] U.S. Cl. ..... 112/129; 83/347

[58] Field of Search ..... 112/122.3, 129, 112/130, 152, 147, 470.29, 470.33, 63, 304, 320, 470.36, 307; 83/505, 425.2, 425.3, 377, 902, 659, 346, 498, 499; 30/206, 263, 265, 264, 276

[56] References Cited

U.S. PATENT DOCUMENTS 3,610,493 10/1971 Brocklehurst ..... 112/130 X
4,594,955 6/1986 Lichtenberg ..... 112/470.36 X
4,624,198 11/1986 Beam et al. ..... 112/304 X
4,846,032 7/1989 Jampathom et al. ..... 83/425.2 X
5,067,380 11/1991 Seefeldt ..... 83/505 X
5,458,074 10/1995 Kojima et al. ..... 112/304 X
5,515,757 5/1996 O'Conner et al. ..... 83/347

*Primary Examiner*—Ismael Izaguirre
*Attorney, Agent, or Firm*—Morgan & Finnegan, LLP

[57] ABSTRACT

A sewing machine has improved material cutting before stitching. The machine includes a sewing head and stitch area where stitching of strip material occurs. Strip material is fed by a timing belt along a predetermined path of travel into the stitch area. A lower cutter roll is positioned along the predetermined path of travel, and the strip material passes over the lower cutting roll. The lower cutter roll is driven by a transmission system connected to the sewing head motor. At least one circular configured, freely rotatable rotary knife engages the lower cutter roll and any strip material passing thereover is cut before stitching.

45 Claims, 5 Drawing Sheets

SEWING MACHINE WITH MATERIAL CUTTING ROLLS

FIELD OF THE INVENTION

This invention relates to a sewing machine with improved material cutting before stitching, and more particularly to a sewing machine with a rotary cutter.

BACKGROUND OF THE INVENTION

Sewing machines often are used in conjunction with a knife and cutter assembly that cuts the edges from a strip of material fed into the stitch area of a sewing head. Typically, a folder unit is located after the knife and cutter assembly. The folder unit folds the strip of material into a tube. The folded tube then moves into the stitch area of the sewing head, which stitches the tube.

Many of the known knife and cutter assemblies use a feed dog and cam mechanism that often is powered from the sewing head motor. The feed dog and cam mechanism produce a series of "cut and dwell" operations as the needles go in and out of the fabric.

It would be advantageous if a sewing machine could include a continuous cutting operation regardless of how the machine and needles are running. Such cutting would be continuous at fast and low speeds and would not produce any dwell time between cuts. This is advantageous to ensure cutting of difficult fabric materials as well as more efficient use of machine resources.

SUMMARY OF THE INVENTION

In accordance with the present invention, a sewing machine has improved material cutting before stitching. The sewing machine includes a sewing head and stitch area where stitching of strip material occurs. Strip material is fed along a predetermined path of travel into the stitch area. A lower cutter roll is positioned along the predetermined path of travel on which the strip material passes over. The lower cutter roll is rotated, and at least one circular configured, freely rotatable rotary knife engages the lower cutter roll and any strip material passing thereover for cutting the strip material before stitching. A folder typically is positioned after the rotary cutter but before the stitch area of the sewing head.

In one aspect of the present invention, the strip feeder is a feed belt, and more particularly a timing belt, for engaging the strip and moving it along the predetermined path of travel. At least one belt pulley supports the belt and in another aspect of the invention three belt pulleys support the belt.

In order to allow access to the side of the sewing head, a cutter support plate is pivotally mounted adjacent to the sewing head and positioned so that the cutter support plate can be pivoted into a feed and cut position adjacent the stitch area and a position pivoted away from the sewing head to allow ready access to the sewing head adjacent the stitch area. The lower cutter roll, the freely rotatable rotary knife, and the timing belt are all mounted on the cutter support plate. In still another aspect of the invention, the cutter support plate is pivotally mounted to a lower support plate, which in turn is mounted to the sewing head.

In yet another aspect of the present invention, a drive shaft connects one of the timing belt pulleys to a gear box fixed to the sewing head. The drive shaft includes rapidly disengageable universal joints which can be disengaged from each other to allow pivoting motion of the cutter support plate. In still another aspect of the invention, a drive shaft interconnects the gear box and the lower cutter roll. This drive shaft also includes rapidly disengageable universal joints to allow pivoting motion of the cutter support plate.

In a desired aspect of the invention, two rotary knives are spaced from each other for cutting the ends of strip material as it is fed along the predetermined path of travel. Each rotary knife is mounted on a lever arm, which is mounted on a shaft connected to a bracket.

DESCRIPTION OF THE DRAWINGS

The foregoing and other objects and advantages of the present invention will be appreciated more fully from the following description, with reference to the accompanying drawings in which.

DETAILED DESCRIPTION OF THE INVENTION

Figure 1:
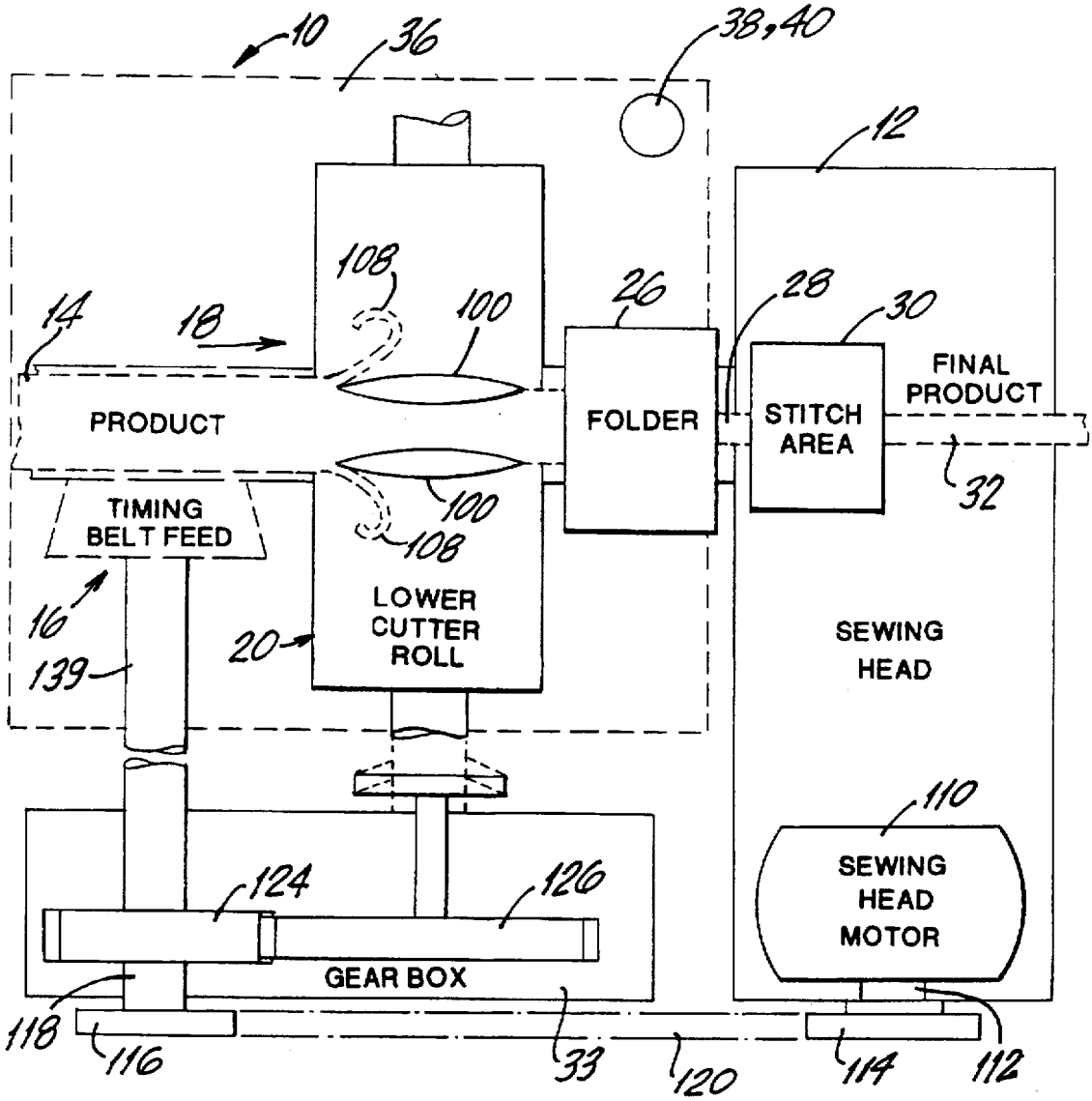
FIG. 1 is a block diagram showing major components of the sewing head and the rotary cutter unit in accordance with the present invention.

Referring now to FIG. 1, there is illustrated in block diagram the rotary cutter unit, illustrated generally at 10, that is positioned adjacent the sewing head 12. The sewing head can be a Juki Model MFB2600, MF860, as well as numerous other types. The block diagram shows the basic components of the sewing head 12 and rotary cutter unit 10. A strip of product 14, which can be a fabric or plastic material (referred hereafter as the "fabric strip 14"), is fed by a timing belt feed mechanism indicated generally at 16, along a predetermined path of travel 18 and across a lower cutter roll indicated generally at 20. Two rotary knives 100, are spaced apart and parallel to each other and cut the side edges of the fabric strip 14. The cut fabric strip 14 then moves into a folder 26, which folds the fabric strip 14 into a tube 28, where it is finally stitched at the stitch area 30 of the sewing head 12 and becomes the final stitched product 32. The timing belt feed and lower cutter roll are driven by a gear box, indicated generally at 33, which is driven from a timing belt off a sewing head motor.

Referring now to FIGS. 2 through 6, details of the rotary cut unit 10 are illustrated and set forth in greater detail below.

Figure 2:
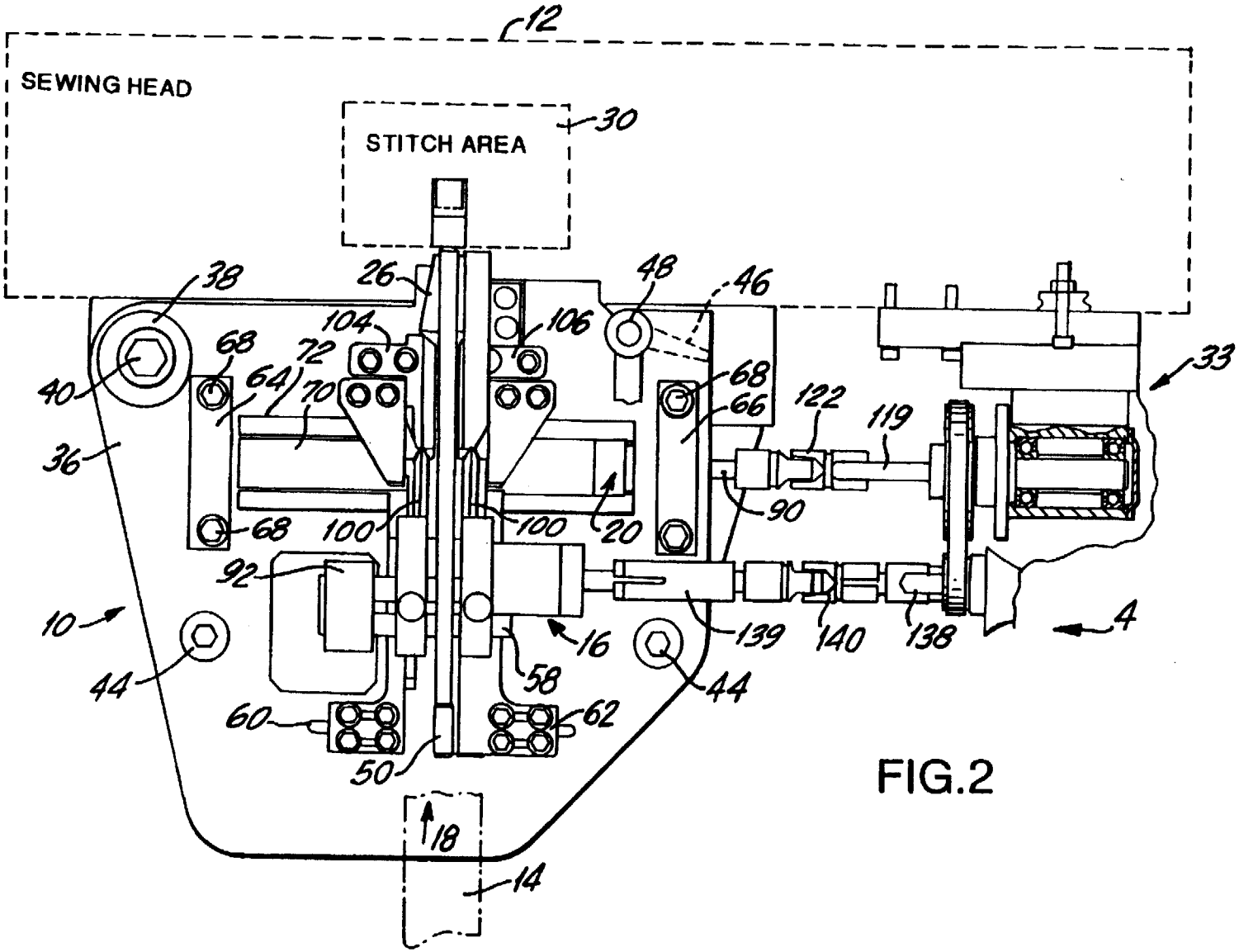
FIG. 2 is a top plan view showing the general outline of the sewing head and the rotary cutter unit including major components of the cutter unit supported by the pivotally mounted cutter support plate.

As illustrated, a lower support plate 34 is fixed to the sewing head 12. A cutter support plate 36 is pivotally mounted by a bushing 38 and shoulder bolt 40 to the lower support plate 34. The shoulder bolt 40 is mounted at the upper left corner of the cutter support plate 36 as illustrated in FIG. 2 so that the entire cutter support plate 36 can be pivotally swung away from the sewing head 12 and stitch area. When the cutter support plate is swung inwardly to the stitch area 30, it is in a feed and cut position and is retained in that position by a set of hand clamps 42 shown in FIG. 3, having locking bolts 44 extending through both the cutter support plate 36 and the lower support plate 34. As shown in FIG. 2, the hand clamps 42 engage both the lower support plate 34 and cutter support plate 36. A third hand clamp 46 is positioned at the upper right corner of the cutter support plate 36 as shown in FIG. 2. It also has a locking bolt 48 through the lower support plate 34 and cutter support plate 36.

Figure 5:
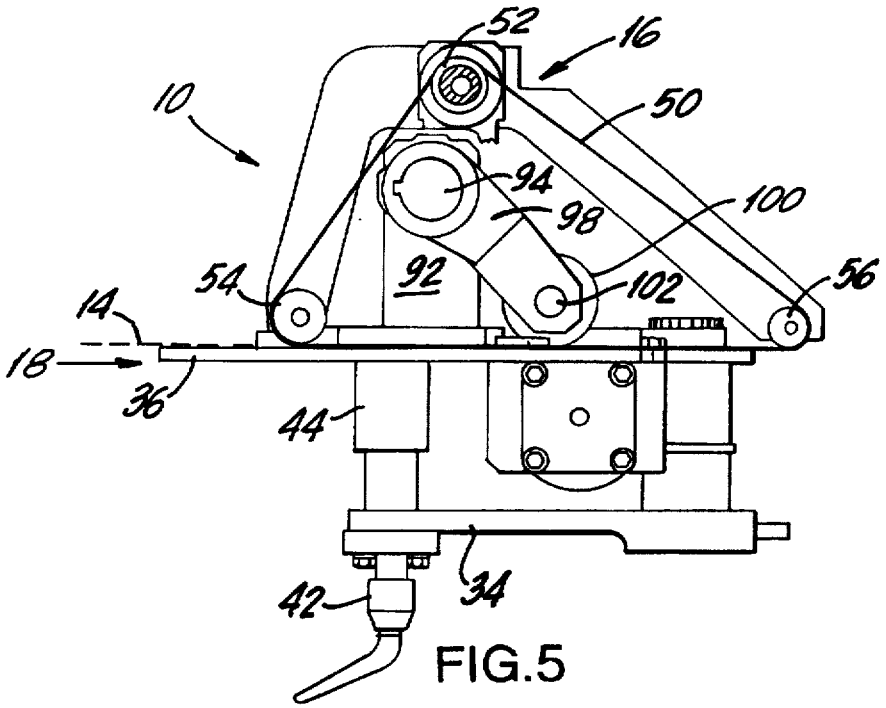
FIG. 5 is a side elevation view taken generally along line 5—5 of FIG. 3 showing the timing belt, and a lever arm supporting a rotary knife.

As shown in FIG. 5, a belt 50, and more particularly a timing belt in the present illustrated embodiment, is mounted on three pulleys 52, 54, 56 that are supported by a timing belt mounting bracket 58 secured onto the cutter support plate 36. The three timing belt pulleys 52, 54, 56 form a substantially triangular configuration as shown in FIG. 5. The top, or first timing belt pulley 52 is a driven pulley, while the left, or second time belt pulley 54 is positioned where the fabric strip enters. The right, or third pulley 58 forms the discharge point of the fabric strip 14 into the stitch area 30. As the top driven pulley 52 is rotated, the timing belt 50 moves and forces any fabric strip 14 adjacent the second entrance pulley 54 into the cutter unit 10 and moves the fabric strip along the predetermined path of travel 18 to the stitching area 30. Respective left and right guides 60, 62 stabilize the fabric strip 14 as the timing belt 50 draws the fabric strip along the predetermined path of travel 18. The timing belt 50 is typically positioned on the pulleys 52, 54, 56 and the mounting bracket 58 so that the timing belt 50 exerts a biasing force against the cutter support plate 36. Thus, the fabric is "nipped" between the timing belt 50 and the cutter support plate 36 and forcibly moved by the rotating timing belt 50.

Figure 3:
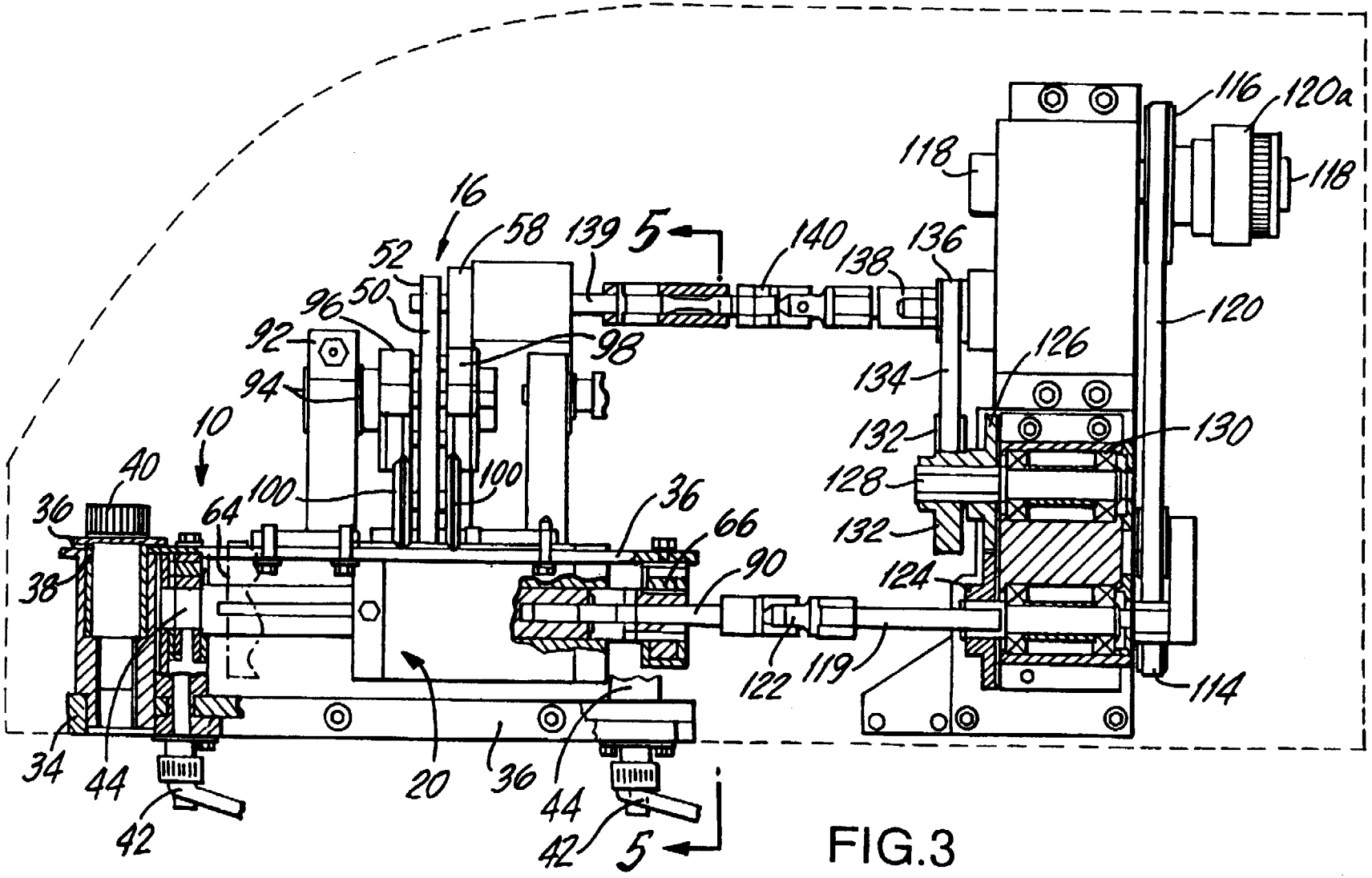
FIG. 3 is a side elevation view of the rotary cutter unit and gear box mounted to the sewing head.

The lower cutter roll 20 is mounted on two respective bearing block housings 64, 66 which are supported below the cutter support plate 36 at its bottom surface as shown in FIG. 3. The bearing block housings 64, 66 are fixed by standard bolts 68 extending through the top portion of the cutter support plate 36. A top portion 70 of the lower cutter roll 20 extends upward through a cutout 72 in the cutter support plate 36 as shown in FIGS. 2 and 3.

Figure 6:
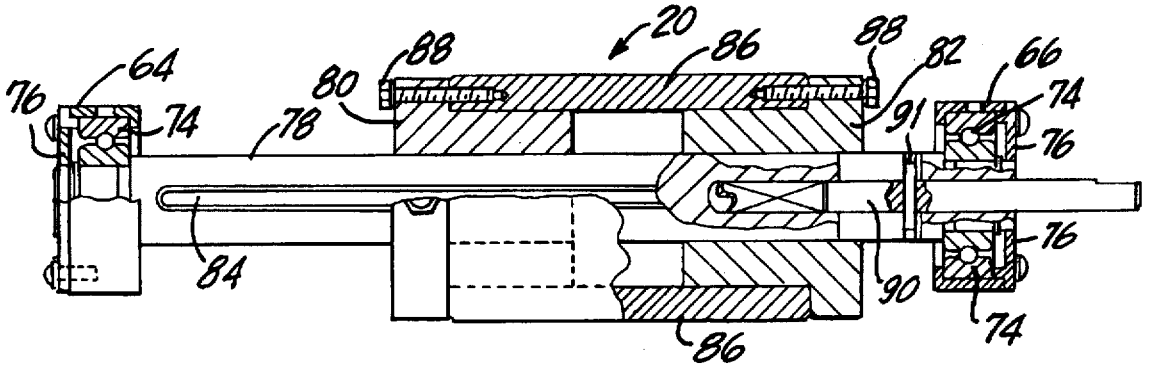
FIG. 6 is a partial sectional view of the lower cutter roll.

FIG. 6 illustrates in greater detail the lower cutter roll 20 and shows the bearing block housings 64, 66 on either side of the lower cutter roll 20. Each bearing block housing 64, 66 includes a ball bearing 74 and cover 76. A main support shaft 78 is mounted and supported by the bearing block housings 64, 66. Two opposing bushings 80, 82 are mounted on the main support shaft 78 and held by a woodruff key 84. The bushings 80, 82 include a section of smaller diameter in which a cylindrical mandrel 86 formed of a wear reducing material, such as plastic, is received as shown in FIG. 6. The plastic mandrel 86 is held to the bushings 80, 82 by fasteners such as standard bolts 88. A smaller "driven" shaft 90 extends out from the main support shaft 78 and forms a disconnected shaft, which can be positioned relative to the main support shaft by a dowel pin 91. This disconnected shaft 90 allows the bushings 80, 82 and plastic mandrel 86 to be moved axially.

As shown in greater detail in FIG. 3, a rotary knife bracket 92 supports a bracket shaft 94 on which two parallel spaced lever arms 96, 98, i.e., knife holders, are mounted. A circular configured, freely rotatable rotary knife 100 is mounted on a knife support shaft 102 extending through each lever arm 96, 98. The lever arms 96, 98 are movable on the bracket shaft 94 so that the spacing between knives 100 is adjustable. Each rotary knife 100 engages the lower cutter roll 20 and any fabric strip 14 passing thereover for cutting the fabric strip before stitching.

Each rotary knife 100 typically is formed of a hardened steel. Because the rotary knives 100 engage a softer material, i.e. the plastic mandrel 86, the knife edges do not wear. When too deep a groove is being formed within the plastic material of the mandrel 86 during machine operation and cutting, the bushings 80, 82 and plastic mandrel 86 can be moved axially on the bracket shaft 94 so that the knife edge then engages another part of the plastic mandrel. The knife lever arms 96, 98 can be biased by a spring or other means into engagement with the lower cutter roll 20. Positioned adjacent the two knives are respective left and right rear guides 104, 106 that not only force the scrap 108 produced from the cut fabric strip away from the rotary knives 100, but also continue to guide the fabric strip into the stitch area.

In accordance with the present invention, the disconnected, smaller shaft 90 of the lower cutter roll 20 and the first or top drive pulley 52 of the timing belt 50 are driven from power derived from a sewing head motor 110.

Figure 4:
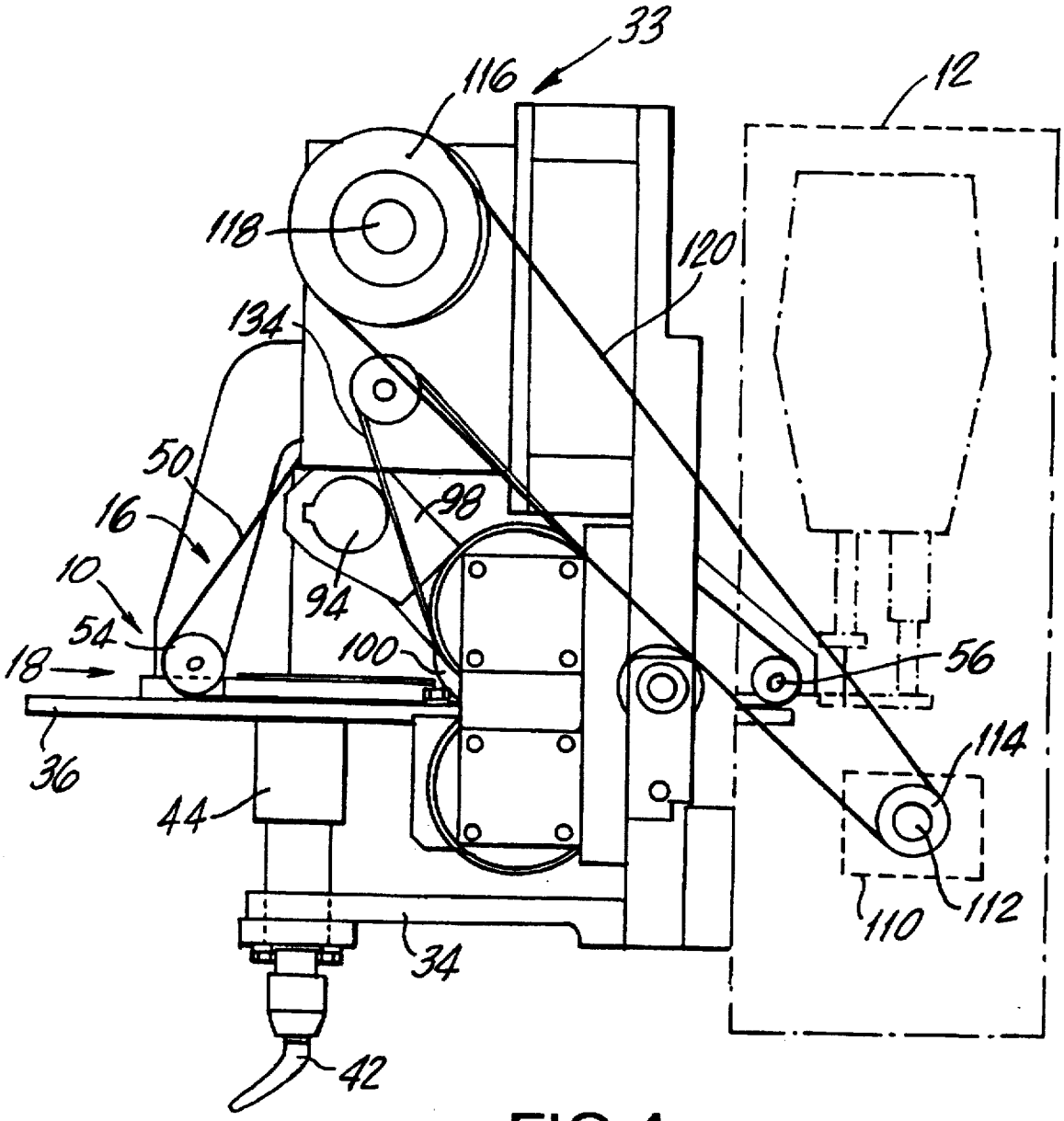
FIG. 4 is a right side elevation view looking in the direction of arrow 4 of FIG. 2 showing major components of the gear box, rotary cutter unit, and the drive pulley extending from the sewing head motor output shaft to the main drive shaft of the gear box.

A power output shaft 112 of the sewing head motor 110 includes a drive pulley 114. The gear box 53 fixed to the sewing head 12 includes a main drive pulley 116 at the rear portion, FIG. 3, which is mounted on the main drive shaft 118 of the gear box. A drive belt 120 connects the two pulleys 114, 116 as shown in FIG. 4. Additionally, a hand crank **120*a* is connected onto the end of the main drive shaft 118 to allow hand turning. The main drive shaft 118 connects internally to an output shaft 119 which connects via a universal joint coupling 122 to the smaller shaft 90 of the lower cutter roll 20. The universal joint coupling 122 can be readily disengaged so that the transmission connection between the gear box 33 and lower cutter roll 20 can be broken to allow pivoting motion of the cutter support plate 36 on the bushing 38**.

A spur gear 124 is mounted on the main drive shaft 118 and engages a second spur gear 126 mounted on a second shaft 128 within a bearing block assembly 130 within the gear box 33. This second shaft 128 has a drive pulley 132 mounted thereon located outside the gear box. A timing drive belt 134 engages an extension pulley 136 mounted on an extension shaft 138 of the gear box parallel to the main drive shaft 118. A second extension shaft 139 connects to the drive pulley 52 of the timing belt 50. A universal joint coupling 140 connects between the two shafts 138, 139 and allows ready disengagement so that the cutter support plate 36 can be pivoted away from the stitch area.

In machine operation, the fabric strip 14 engages the timing belt 50 at the second entrance pulley 54, which forces the fabric strip between the left and right guides 60, 62 along the predetermined path of travel 18 over the lower cutter roll 20. The edges of the fabric strip are cut by the rotary knives 100. The fabric strip is then guided by the left and right rear guides 104, 106 which also act to discard the scrap 108 produced by the edge cutting. The fabric strip 14 enters the folder 26, which folds the material into a looped configuration, which is then stitched within the stitch area 30. The timing belt 50 and lower cutter roll 20 are driven through the gear box 33 by the power output derived from the sewing head motor. When the knives 100 have worn too large a groove within the plastic mandrel, the lower cutter roll is moved axially so that the knives engage a new unworn spot.

When maintenance has to be done on the sewing head, the universal joint couplings on the shafts are then disconnected, and the clamps released and unlocked so that the upper support plate forming the rotary knife unit can be pivoted away from the stitch area.

It is to be understood that the above description is only one preferred embodiment of the invention. Numerous other arrangements may be devised by one skilled in the art without departing from the spirit and scope of the invention.

That which is claimed is:

1. A sewing machine with improved material cutting before stitching comprising a sewing head and stitch area where stitching of strip material occurs, means for feeding strip material along a predetermined path of travel into the stitch area, a lower cutter roll positioned along the predetermined path of travel on which the strip material passes over, means for rotating the lower cutter roll, and at least one circular configured, freely rotatable rotary knife engaging the lower cutter roll and any strip material passing thereover for cutting the strip material before stitching, and wherein said lower cutter roll is formed of a softer material than said rotary knife, and including means supporting said lower cutter roll for axial movement to move the lower cutter roll and prevent excessive knife wear at one point on the surface of the lower cutter roll.

2. The machine according to claim 1 wherein said strip feeding means comprises a belt for engaging the strip and moving it along the predetermined path of travel, and at least one belt pulley supporting the belt.

3. The machine according to claim 2 including a fabric support surface on which the fabric lies and defining a portion of the predetermined path of travel, and including means for biasing the belt against the strip into engagement with the support surface.

4. The machine according to claim 2 including a sewing head motor, and transmission means interconnecting a pulley of the belt and the sewing head motor for driving the belt from power derived from the sewing head motor.

5. The machine according to claim 1 including a sewing head motor, and including transmission means interconnecting said lower cutter roll and said sewing head motor for driving the lower cutter roll from power derived from the sewing head motor.

6. The machine according to claim 1 including a knife support, a lever arm pivotally mounted to the support, wherein said rotary knife is rotatably supported by said lever arm.

7. The machine according to claim 1 including two rotary knives that are spaced for cutting the edge material from the fed strip material.

8. The machine according to claim 1 including means for biasing the rotary knife into engagement with the lower cutter roll.

9. The machine according to claim 1 including a folder positioned after the lower cutter roll and rotary knife, and before the stitching area, for folding the cut material into loops for subsequent stitching.

10. A sewing machine with improved material cutting before stitching comprising a sewing head and stitch area where stitching of strip material occurs, a cutter support plate pivotally mounted adjacent to the sewing head and positioned so that the cutter support plate can be pivoted into a feed and cut position adjacent the stitch area, and a position pivoted away from the sewing head to allow ready access to the sewing head adjacent the stitch area, means mounted on the cutter support plate for feeding strip material into the stitch area along a predetermined path of travel extending over the cutter support plate when positioned in the feed and cut position, a lower cutter roll mounted on the cutter support plate on which strip material passes over, and at least one circular configured, freely rotatable rotary knife engaging the lower cutter roll and any strip material passing thereover for cutting the strip material before stitching.

11. The machine according to claim 10 including a lower plate mounted to the sewing head, wherein said cutter support plate is pivotally mounted thereto.

12. The machine according to claim 11 including locking clamps engaging the lower support plate and the cutter support plate for locking and unlocking the cutter support plate relative to the fixed lower support plate and allowing pivoting motion of the cutter support plate.

13. The machine according to claim 10 wherein said strip feeding means comprises a belt for engaging the strip and moving it along the predetermined path of travel, and at least one belt pulley mounted on the cutter support plate and supporting the belt.

14. The machine according to claim 13 wherein the cutter support plate defines a fabric support surface on which the fabric lies, and including means for biasing the belt against the strip into engagement with the cutter support plate.

15. The machine according to claim 14 including a sewing head motor, and transmission means interconnecting a pulley of the belt and the sewing head motor for driving the belt from power derived from the sewing head motor.

16. The machine according to claim 15 wherein said transmission means includes a gear box mounted on the sewing head and receiving power from the sewing head motor, and a drive shaft interconnecting the gear box and the pulley of the belt.

17. The machine according to claim 16 wherein said drive shaft includes a universal joint that may be rapidly disconnected to allow pivoting motion of the cutter support plate.

18. The machine according to claim 10 wherein said lower cutter roll is formed from a wear reducing material material to prevent excessive rotary knife wear.

19. The machine according to claim 18 including means supporting said lower cutter roll for allowing axial movement of the lower cutting roll to prevent excessive knife wear at one point on the surface of the lower cutter roll.

20. The machine according to claim 10 including a sewing head motor, and including transmission means interconnecting said lower cutter roll and said sewing head motor for driving the lower cutter roll from power derived from the sewing head motor.

21. The machine according to claim 20 wherein said transmission means includes a gear box mounted on the sewing head and receiving power from the sewing head motor, and a drive shaft interconnecting the gear box and the lower cutter roll for rotating the roll during machine operation.

22. The machine according to claim 21 wherein said drive shaft includes a universal joint that may be rapidly disengaged to allow pivoting motion of the cutter support plate.

23. The machine according to claim 10 a knife support, a lever arm pivotally mounted to the support, where said rotary knife is rotatably supported by said lever arm.

24. The machine according to claim 10 including two rotary knives that are spaced for cutting the edge material from the fed strip material.

25. The machine according to claim 24 including a knife support, two lever arms mounted to the support, wherein respective rotary knives are supported by said lever arms and movable relative to each other to adjust spacing therebetween.

26. The machine according to claim 10 including means for biasing the rotary knife into engagement with the lower cutter roll.

27. A strip feed and cutting apparatus adapted to be mounted adjacent a sewing head and stitch area where stitching of strip material occurs, comprising a cutter support plate adapted to be pivotally mounted adjacent to a sewing head and positioned so that the cutter support plate can be pivoted into a feed and cut position adjacent a stitch area and pivoted into a position away from a sewing head to allow ready access to a sewing head adjacent a stitch area, means mounted on the cutter support plate for feeding strip material into a stitch area along a predetermined path of travel extending over the cutter support plate when in the feed and cut position, a lower cutter roll mounted on the cutter support plate on which strip material passes over, and at least one circular configured, freely rotatable rotary knife engaging the lower cutter roll and any strip material passing thereover for cutting the strip material before stitching.

28. The apparatus according to claim 27 wherein said strip feeding means comprises a belt for engaging the strip and moving it along the predetermined path of travel, and at least one belt pulley mounted on the cutter support plate and supporting the belt.

29. The apparatus according to claim 27 wherein the cutter support plate defines a fabric support surface on which the fabric lies, and including means for biasing the belt against the strip into engagement with the cutter support plate.

30. The apparatus according to claim 27 including drive shaft interconnecting a pulley of the belt for driving the belt, said drive shaft having means for connecting to a gear box mounted on a sewing head.

31. The apparatus according to claim 30 wherein said drive shaft includes a universal joint that may be rapidly disengaged.

32. The apparatus according to claim 27 wherein said lower cutter roll is formed from a wear reducing material to prevent excessive rotary knife wear.

33. The apparatus according to claim 27 including means supporting said lower cutter roll for axial movement to allow movement of the lower cutter roll and prevent excessive knife wear at one point on the surface of the lower cutter roll.

34. The apparatus according to claim 27 including a drive shaft interconnecting said lower cutter roll for driving the lower cutter roll, and including means mounted on the drive shaft and adapted for interconnection to a gear box mounted on a sewing head.

35. The apparatus according to claim 34 wherein said drive shaft includes a universal joint that may be rapidly disengaged.

36. The apparatus according to claim 17 including a knife support, a lever arm pivotally mounted on the support, wherein said rotary knife is rotatably supported by said lever arm.

37. The apparatus according to claim 17 including two rotary knives that are spaced for cutting the edge material from the fed strip material.

38. The apparatus according to claim 37 including a knife support, two lever arms mounted to the support, wherein respective rotary knives are supported by said lever arms and movable relative to each other to adjust the spacing therebetween.

39. The apparatus according to claim 17 including means for biasing the rotary knife into engagement with the lower cutter roll.

40. A method of cutting material for stitching on a sewing machine comprising the steps of feeding a strip of material along a predetermined path of travel into a stitch area of a sewing head where stitching occurs while also feeding the strip before it enters the stitch area over a rotating lower cutter roller positioned along the predetermined path of travel, and engaging the strip material against the lower cutter roll with a circular configured, rotary knife for cutting the strip material before stitching and wherein said lower cutter roll is formed of a softer material than said rotary knife, and including the step of moving the lower cutter roll axially into a new position for engaging the rotary knife and preventing excessive knife wear on one location of the bottom cutter roll.

41. The method according to claim 40 including feeding the strip material by engaging the strip against a moving belt.

42. The method according to claim 41 including driving the belt from power derived from a stitch head motor.

43. The method according to claim 40 including rotating the lower cutter roll from power derived from a stitch head motor.

44. The method according to claim 40 including cutting the edges of strip material from two spaced rotary knives.

45. The method according to claim 40 including biasing the rotary knife into engagement with the lower cutter roll.

* * * * *

UNITED STATES PATENT AND TRADEMARK OFFICE

CERTIFICATE OF CORRECTION

PATENT NO. : 5,694,870

DATED : December 9, 1997

INVENTOR(S) : Morgulis, Lazar A., et al.

It is certified that error appears in the above-indentified patent and that said Letters Patent is hereby corrected as shown below:

Col. 8, line 9, change "claim 17" to --claim 27--.

Col. 8, line 13, change "claim 17" to --claim 27--.

Col. 8, line 21, change "claim 17" to -- claim 27--.

Signed and Sealed this

Sixteenth Day of June, 1998

Bruce Lehman

*Attest:*

BRUCE LEHMAN

*Attesting Officer*

*Commissioner of Patents and Trademarks*